United States Patent [19]

Kikuta

[11] Patent Number: 4,619,493

[45] Date of Patent: Oct. 28, 1986

[54] CONNECTING AND ENGAGING FIXTURE FOR ELECTRIC CONNECTOR

[75] Inventor: Sigeru Kikuta, Tokyo, Japan

[73] Assignee: Hirose Electric Co., Ltd., Tokyo, Japan

[21] Appl. No.: 776,865

[22] Filed: Sep. 17, 1985

[30] Foreign Application Priority Data

Oct. 16, 1984 [JP] Japan ..... 59-216849

[51] Int. Cl.[4] ..... H01R 13/631

[52] U.S. Cl. ..... 339/91 R; 339/99 R; 339/103 M; 339/143 R

[58] Field of Search ..... 339/17 C, 17 LC, 91 R, 339/97 P, 98, 99 R, 143 R, 103 M

[56] References Cited

U.S. PATENT DOCUMENTS

| | | | |
|---|---|---|---|
| 2,760,174 | 8/1956 | Burtt et al. | 339/91 R |
| 3,329,925 | 7/1967 | Johnson et al. | 339/91 R |
| 3,355,699 | 11/1967 | Oshva | 339/99 R |
| 3,536,336 | 2/1971 | Johnson et al. | 339/91 R |
| 4,145,103 | 3/1979 | Knowles | 339/99 R |
| 4,188,083 | 2/1980 | Knowles | 339/99 R |
| 4,296,989 | 10/1981 | Larson et al. | 339/99 R |
| 4,458,972 | 7/1984 | Malmberg et al. | 339/91 R |

FOREIGN PATENT DOCUMENTS 59-11424 7/1984 Japan .

*Primary Examiner*—John McQuade

*Attorney, Agent, or Firm*—Fleit, Jacobson, Cohn & Price

[57] ABSTRACT

There is disclosed a connecting and engaging fixture for an electric connector having an insulating housing proper in which a contact is disposed and which is snugly fitted with an insulating housing proper of a mating electric connector, and a cable restraint plate which is assembled to the insulating housing proper and which serves to fix a cable end part to be spliced to the contact. The connecting and engaging fixture comprises a locking portion at its front end part, which serves to hold snug fitting between the electric connector and the mating electric connector in engagement, a rearward falling-off preventive engagement portion at its intermediate part, which serves to check the fixture from falling-off rearwards in engagement with a rearward falling-off preventive engagement step provided in a fixture inserting hole formed at a side part of the insulating housing proper, and a forward falling-off preventive shoulder and a cable restraint plate-engagement portion at its rear end part, the former of which serves to check the fixture from falling-off frontwards in engagement with a forward falling-off preventive engagement step provided in the fixture inserting hole, and the latter of which engages the cable-restraint plate in order to fasten the cable restraint plate assembled to the insulating housing proper in engagement.

6 Claims, 25 Drawing Figures

FIG. 4A
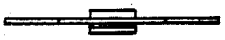
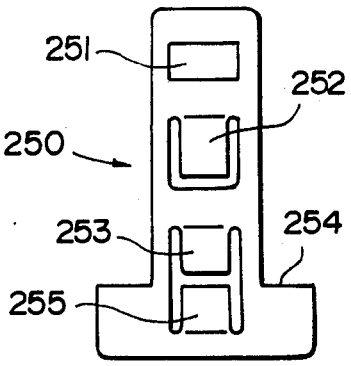
FIG. 4B
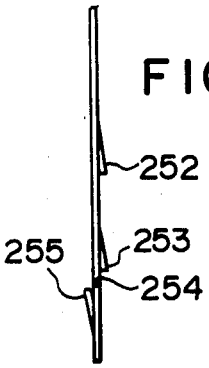
FIG. 4C
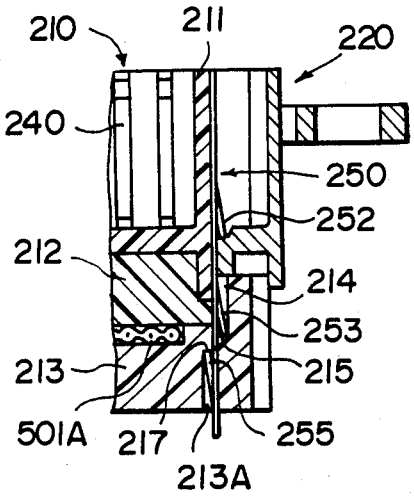
FIG. 5

FIG. 6A
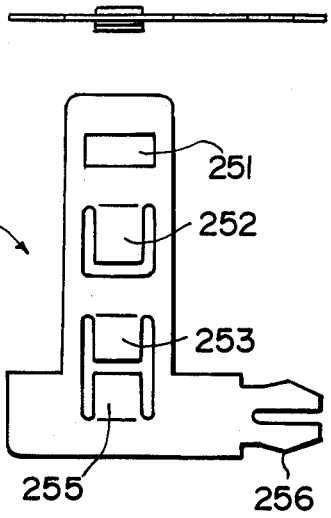
FIG. 6B
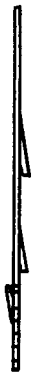
FIG. 6C
FIG. 7A
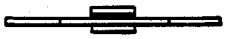
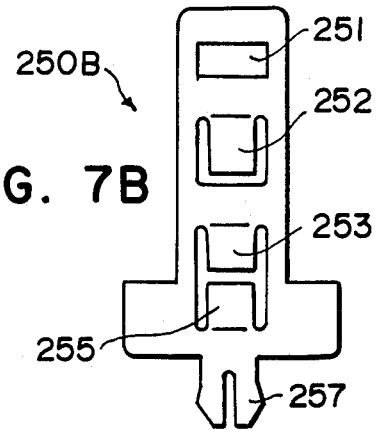
FIG. 7B
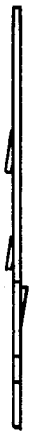
FIG. 7C FIG. 8A
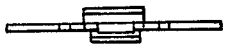
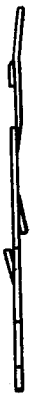
FIG. 8C
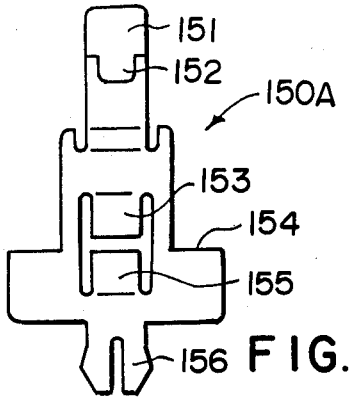
FIG. 8B
FIG. 9A
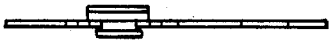
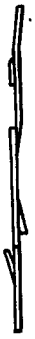
FIG. 9C
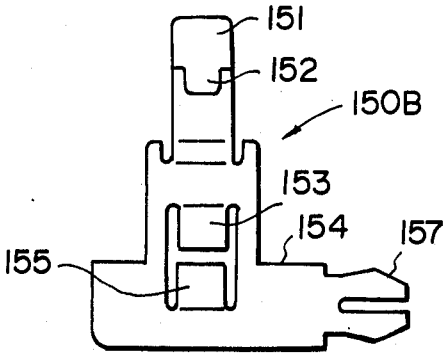
FIG. 9B

CONNECTING AND ENGAGING FIXTURE FOR ELECTRIC CONNECTOR

BACKGROUND OF THE INVENTION

1. Field of the Invention

The present invention relates to an electric connector, and more particularly to a connecting and engaging fixture for an electric connector.

2. Description of the Prior Art

As a fixture for an electric connector, there has heretofore been a metallic engagement member in a connecting and engaging device for a ribbon cable as disclosed in the official gazette of Japanese Utility Model Registration Application Publication No. 59-11424. The metallic engagement member is used in combination with a keeper member made of a resinous material in order to fix a cable end part between it and the top face of a connector proper. It functions to enhance the strength of the resinous keeper member and also to fix this keeper member to the connector proper.

The prior-art metallic engagement member for an electric connector as stated above performs merely the functions of reinforcing the resinous keeper member and fixing the keeper member to the conductor proper, and it does not perform any other function. In recent years, the miniaturization of electric connectors has been required in the fields of electronic equipment etc. In general, it is important for miniaturization to effect as many functions as possible with a single member of simple structure. From such viewpoint, the aforementioned metallic engagement member for an electric connector in the prior art is not a multifunctional one and cannot always meet the requirement of the miniaturization.

In view of such problem, the present invention has for its object to provide a connecting and engaging fixture for an electric which has a very simple structure and which can demonstrate many functions.

SUMMARY OF THE INVENTION

According to the present invention, a connecting and engaging fixture for an electric connector, the electric connector having an insulating housing proper in which a contact is disposed and which is snugly fitted with an insulating housing proper of a mating electric connector, and a cable restraint plate which is assembled to the insulating housing proper and which serves to fix a cable end part to be spliced to the contact; is provided at its front end part with a locking portion which serves to hold snug fitting between the electric connector and the mating electric connector in engagement; at its intermediate part with a rearward falling-off preventive engagement portion which serves to check the fixture from falling-off rearwards in engagement with a rearward falling-off preventive engagement step provided in a fixture inserting hole formed at a side part of the insulating housing proper; and at its rear end part with a forward falling-off preventive shoulder and a cable restraint plate-engagement portion; the former of which serves to check the fixture from falling-off fronteards in engagement with a forward falling-off preventive engagement step provided in the fixture inserting hole, and the latter of which engages the cable restraint plate in order to fasten the cable restraint plate assembled to the insulating housing proper in engagement.

The present invention will be described more in detail in conjunction with embodiments thereof with reference to the accompanying drawings.

BRIEF DESCRIPTION OF THE DRAWINGS

FIGS. 4(A), (B) and (C) are a plan view, a front view and a side view respectively, showing one of the connecting and engaging fixtures for an electric connector;

FIG. 5 is a partial vertical sectional view showing the state in which the fixture in FIG. 4 is mounted on the side part of the female insulating housing of the receptacle connector in FIG. 1;

FIGS. 6, 7, 8 and 9 are views showing various different embodiments of the fixtures according to the present invention;

DESCRIPTION OF THE PREFERRED EMBODIMENTS

Figure 1:
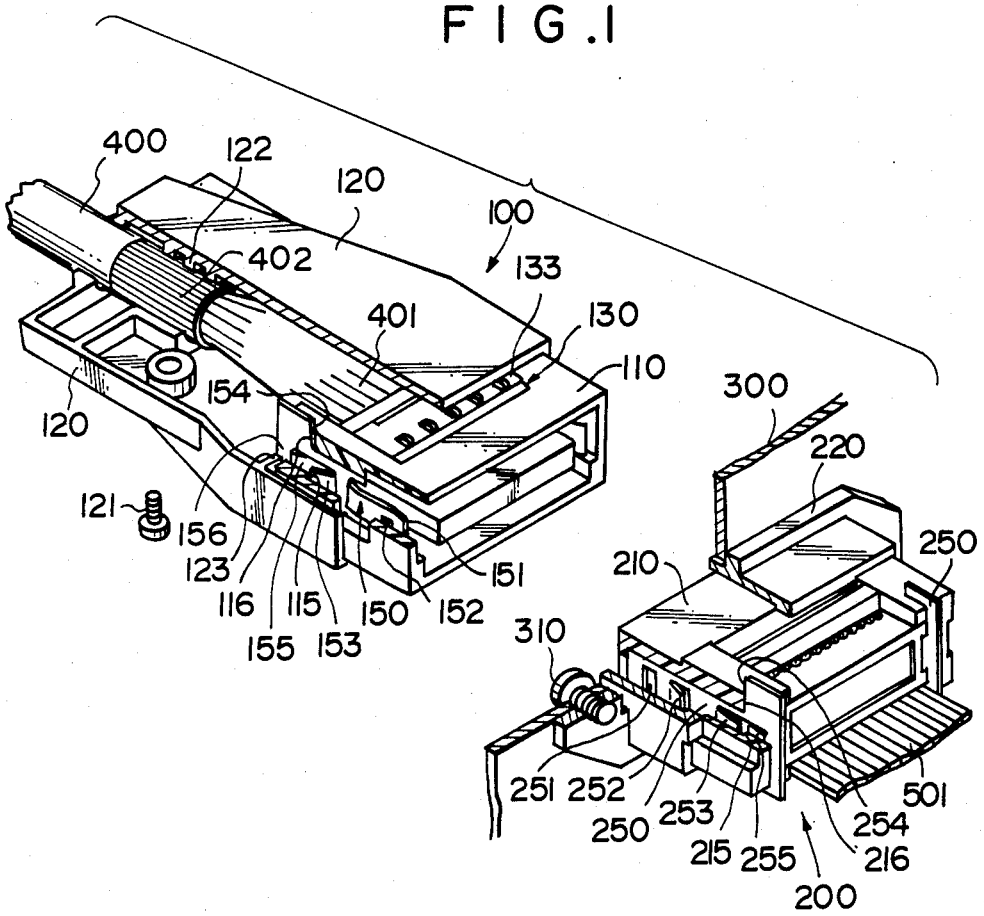
FIG. 1 is a perspective view, partly broken away, showing the state of a plug connector and a receptacle connector before being snugly fitted, each of the connectors employing connecting and engaging fixtures for an electric connector according to the present invention.

FIG. 1 is a perspective view, partly broken away, showing the state of a plug connector and a receptacle connector before being snugly fitted, each of the connectors employing a connecting and engaging fixture for an electric connector according to the present invention. In this embodiment, the plug connector 100 principally comprises a male insulating housing 110 in which a male contact is disposed, and a pair of plug cases 120 which constitute a conductive shield case surrounding the male insulating housing 110. The plug cases 120 are assembled to each other so as to sandwich the male insulating housing 110 from both the sides thereof and are clamped and fixed using screws 121, thereby to be mounted around the male insulating housing 110.

On the other hand, the receptacle connector 200 principally comprises a female insulating housing 210 in which a female contact is disposed, and a receptacle case 220 which constructs a conductive shield case surrounding the female insulating housing 210. The receptacle case 220 of this receptacle connector 200 is attached and fixed to a mounting panel 300 with a clamping screw 310 so as to be earthed.

The plug connector 100 is further furnished with earth plates 130 at both the side walls of the male insulating housing 110. A part of each earth plate 130 touches the plug cases 120 in a manner to be held between these plug cases 120 and the male insulating housing 110, while the other part of the earth plate 130 lies above the side wall of the male insulating housing 110 and is exposed outside the plug cases 120.

In such plug connector 100 and receptacle connector 200, connecting and engaging fixtures for electric connectors 150 and 250 according to the present invention are respectively mounted on both the sides of the insulating housings 110 and 210.

Figure 2A:
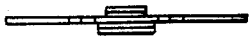
FIGS. 2(A), (B) and (C) are a plan view, a front view and a side view respectively, showing one of the connecting and engaging fixture for an electric connector.
Figure 2C:
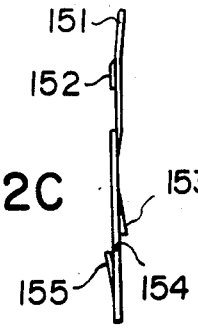
Figure 2B:
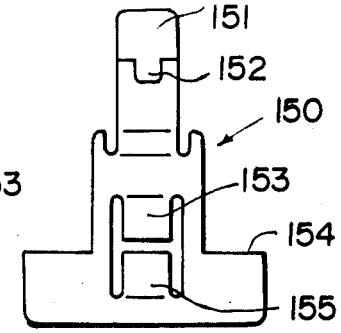
Figure 3:
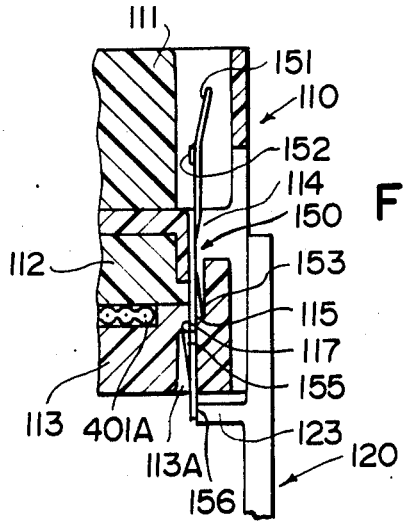
FIG. 3 is a partial verical sectional view showing the state in which the fixture in FIG. 2 is mounted on the side part of the male insulating housing of the plug connector in FIG. 1.

How, the details of the connecting and engaging fixture for an electric connector 150 will be explained with reference to FIGS. 2 and 3. FIGS. 2(A), (B) and (C) are a plan view, a front view and a side view respectively, showing one of the connecting and engaging fixtures for an electric connector 150, while FIG. 3 is a partial vertical sectional view showing the state in which the fixture in FIG. 2 is mounted on the side part of the male insulating housing 110 of the plug connector 100 in FIG. 1. As best shown in FIG. 3, the male insulating housing 110 is composed of an insulating housing proper 111 for disposing the male contact therein, an insulating keeper housing 112, and a cable restraint plate 113. Each side wall of the insulating housing proper 111 is formed with a fixture inserting hole 114 for inserting and mounting the fixture 150.

As best shown in FIG. 2, the connecting and engaging fixture for an electric connector 150 is constructed as a male fixture, and it is unitarily formed by punching from a springy metal sheet. In this fixture 150, the foremost end part thereof is somewhat bent outwards into a locking entrance portion 151 for introducing the front end of the mating female fixture 250 to be described later, and a locking protrusion 152 for engagement with the locking opening of the mating female fixture 250 to be described later is provided just below the locking entrance portion 151. Further, as best shown in FIG. 3, this fixture 150 is provided at its intermediate part with a rearward falling-off preventive engagement portion 153 which checks the fixture 150 from falling-off rearwards in engagement with a rearward falling-off preventive engagement step 115 formed in the fixture inserting hole 114 of the insulating housing proper 111. Provided at the rear end part of this fixture 150 are a forward falling-off preventive shoulder 154 which checks the fixture 150 from falling-off frontwards in engagement with a forward falling-off preventive engagement step 116 (refer to FIG. 1) formed in the fixture inserting hole 114, and a cable restraint plate-engagement portion 155 which fastens the cable restraint plate 113 in engagement with the sideward engagement step 117 of the cable restraint plate 113 assembled to the insulating housing proper 111 as well as the insulating keeper housing 112.

As best shown in FIG. 1, a cable 400 is spliced to the plug connector 100 which is furnished with such male fixtures 150 on both the sides thereof. A method of splicing the cable 400 will be briefly explained. First, the male fixture 150 has the front end of the locking entrance portion 151 thereof inserted from the rear end of the fixture inserting hole 114 of the insulating housing proper 111. At this time, the rearward falling-off preventive engagement portion 153 snaps into engagement with the rearward falling-off preventive engagement step 115 provided in the fixture inserting hole 114, and the forward falling-off preventive shoulder 154 comes into engagement with the forward falling-off preventive engagement step 116, whereby the fixture 150 is secured to the insulating housing 111 and is integrated therewith (refer to FIG. 3). Subsequently, the terminal end part of the cable 400 to be spliced is stripped, a cable core 401 is disjoined, and a cable shield 402 is folded back onto the armor of the cable 400. As shown in FIG. 3, the end part 401A of the cable core 401 is spliced by solderless contact connection or the like to the splicing portion of the male contact which is arranged in the insulating housing proper 111 and which projects from the lower end face of the insulating keeper housing 112, and the cable restraint plate 113 is assembled on the splicing. In this case, the cable restraint plate 113 is inserted from the splicing side of the insulating housing proper 111. At that time, the cable restraint plate-engagement portion 155 of the fixture 150 is held in engagement with the engagement step 117 which is located at the bottom of the fixture groove 113A of the cable restraint plate 113. Thus, the cable restraint plate 113 fixes the cable end part 401A, and it is fastened to the insulating housing proper 111 as well as the insulating keeper housing 112. Lastly, as best shown in FIG. 1, the pair of plug cases 120 may be assembled from both the sides of the male insulating housing 110 with the cable spliced in this manner and may be clamped and fixed using the clamping screws 121. At this time, a cable clamp portion 122 provided inside the rear end of each plug case 120 touches the cable shield 402 folded back on the armor of the cable 400, in biting fashion, and the inner side of the front end of each plug case 120 lies in pressed touch with the contiguous portion 133 of the earth plate 130. On this occasion, as best shown in FIG. 3, a contiguous protuberance 123 is preferably provided at the inner wall part of the plug case 120 so as to come into touch with a contiguous portion 156 at the rear end part of the fixture 150.

Now, the details of the connecting and engaging fixture for an electric connector 250 will be explained with reference to FIGS. 4 and 5. FIGS. 4(A), (B) and (C) are a plan view, a front view and a side respectively, showing one of the connecting and engaging fixtures for an electric connector 250, while FIG. 5 is a partial vertical sectional view showing the state in which the fixture in FIG. 4 is mounted on the side part of the female insulating housing 210 of the receptacle connector 200 in FIG. 1. As best shown in FIG. 5, the female insulating housing 210 is composed of an insulating housing proper 211 for disposing the female contact 240 therein, an insulating keeper housing 212, and a cable restraint plate 213. Each side wall of the insulating housing proper 211 is formed with a fixture inserting hole 214 for inserting and mounting the fixture 250.

As best shown in FIG. 4, the connecting and engaging fixture for an electric connector 250 is constructed as a female fixture, and likewise to the fixture 150, it is unitarily formed by punching from a springy metal sheet. In this fixture 250, the front end part thereof is provided with the locking opening 251 for engagement with the locking protrusion 152 of the mating male fixture 150 stated before. Further, a case engagement portion 252 for fastening the receptacle case 220 in engagement therewith is provided just below the locking opening 251. This case engagement portion 252 functions also as a contiguous portion which comes into electrically conductive touch with the case 220. Still further, as best shown in FIG. 5, this fixture 250 is provided at its intermediate part with a rearward falling-off preventive engagement portion 253 which checks the fixture 250 from falling-off rearwards in engagement with a rearward falling-off preventive engagement step 215 formed in the fixture inserting hole 214 of the insulating housing proper 211. Provided at the rear end part of this fixture 250 are a forward falling-off preventive shoulder 254 which checks the fixture 250 from falling-off frontwards in engagement with a forward falling-off preventive engagement step 216 (refer to FIG. 1)

formed in the fixture inserting hole 214, and a cable restraint plate-engagement portion 255 which fastens the cable restraint plate 213 in engagement with the sideward engagement step 217 of the cable restraint plate 213 assembled to the insulating housing proper 211 as well as the insulating keeper housing 212.

As best shown in FIG. 1, the end part of a cable core 501 is spliced to the receptacle connector 200 which is furnished with such female fixtures 250 on both the sides thereof. A method of splicing the end part of the cable core 501 will be briefly explained. First, the female fixture 250 is inserted from the rear end of the fixture inserting hole 214 of the insulating housing proper 211. At this time, the rearward falling-off preventive engagement portion 253 snaps into engagement with the rearward falling-off preventive engagement step 215 provided in the fixture inserting hole 214, and the forward falling-off preventive shoulder 254 comes into engagement with the forward falling-off preventive engagement step 216, whereby the fixture 250 is secured to the insulating housing proper 211 and is integrated therewith (refer to FIG. 5). Subsequently, the receptacle case 220 is inserted from the snug fitting side of the insulating housing proper 211 into this insulating housing proper 211 in the state in which the female fixtures 250 are integrated therewith as described above, whereby as best shown in FIG. 5, the case 220 is secured to the insulating housing proper 211 by the case engagement portion 252 of each fixture 250. Next, the end part 501A of the cable core 501 is spliced by solderless contact connection or the like to the splicing portion of the female contact 240 which is arranged in the insulating housing proper 211 and which projects from the lower end face of the insulating keeper housing 212, and the cable restraint plate 213 is assembled on the splicing. In this case, the cable restraint plate 213 is inserted from the splicing side of the insulating housing proper 211. At that time, the cable restraint plate-engagement portion 255 of the fixture 250 is held in engagement with the engagement step 217 which is located at the bottom of the fixture groove 213A of the cable restraint plate 213. Thus, the cable restraint plate 213 fixes the cable end part 501A, and it is fastened to the insulating housing proper 211 as well as the insulating keeper housing 212.

When the plug connector 100 and the receptacle connector 200 having the respective cables spliced in this manner are snugly fitted with each other, the locking protrusion 152 of each male fixture 150 fits into the locking opening 251 of the corresponding female fixture 250, whereby the snug fitting state of the plug connector 100 and the receptacle connector 200 is locked. Under this condition, there are achieved the earth connector of a path extending along the cable shield 402 of the cable 400—the cable clamp portion 122—the plug case 120—the contiguous portion 133 of the earth plate 130—the receptacle case 220—the mounting panel 300, and besides, the earth connection of another path extending along shield 402 of the cable 400—the cable clamp portion 122—the plug case 120—the contiguous protruberance 123 of the plug case 120—the contiguous portion 156 of the fixture 150—the front end part of the fixture 150—the front end part of the fixture 250—the case engagement portion 252 of the fixture 250—the receptacle case 220—the mounting panel 300. Accordingly, more reliable earth connection is done, and reliable defense against electric wave disturbance can be attained.

Next, various other embodiments of the connecting and engaging fixture for an electric connector according to the present invention will be described with reference to FIGS. 6 to 13.

Figure 10:
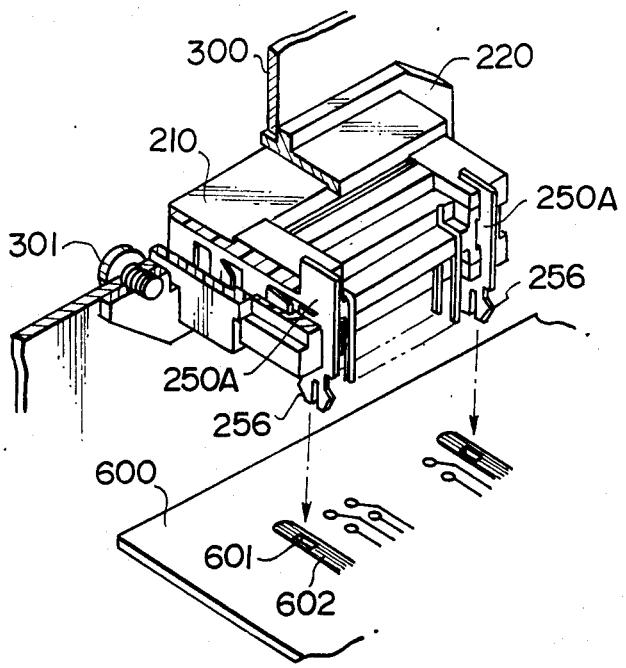
FIGS. 10, 11 and 12 are perspective views showing several examples of use of the fixture in FIG. 6.
Figure 11:
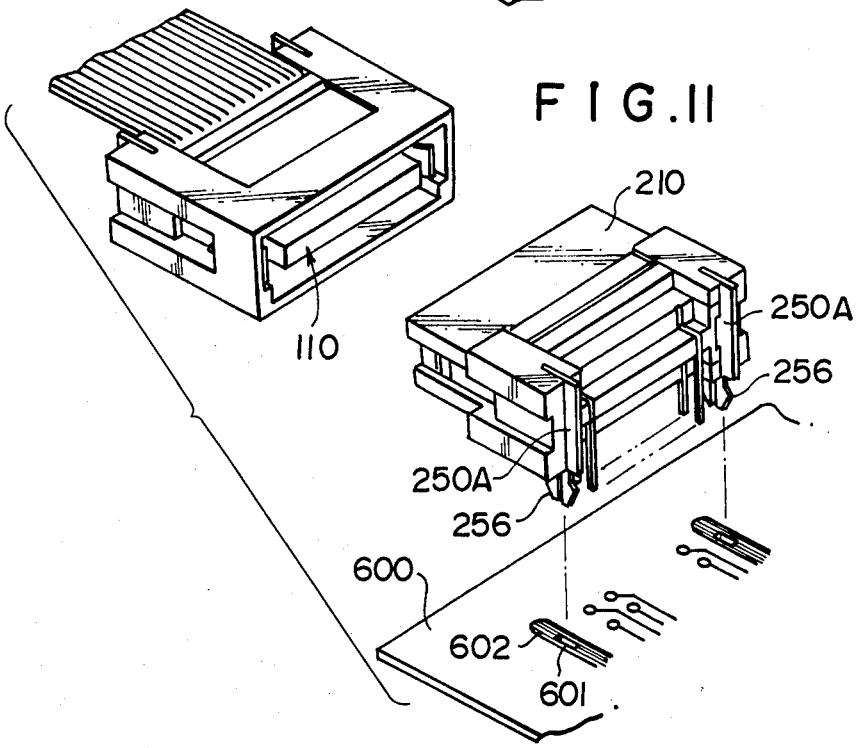
Figure 12:
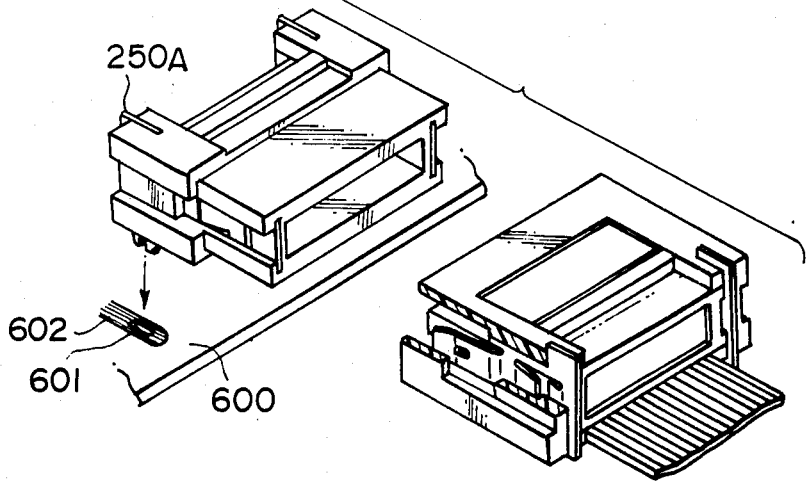

FIGS. 6(A), (B) and (C) are a plan view, a front view and a side view respectively, showing an example of an L-shaped female fixture. The L-shaped female fixture 250A is similar in construction to the female fixture 250 shown in FIG. 4, except that its rear end part is put into an L-shaped portion, the front end of which is provided with board fixation legs 256. Therefore, the corresponding parts are assigned the same reference numerals and shall not be explained in detail. This L-shaped female fixture 250A is suited to attach and fix the receptacle connector in parallel with the plane of a printed circuit board 600 as illustrated in FIGS. 10, 11 and 12. In this case, the board fixation legs 256 of the fixture 250A are inserted into the fixation hole 601 of the circuit board 600 and come into touch with an earth conductor 602 deposited around the hole.

Figure 13:
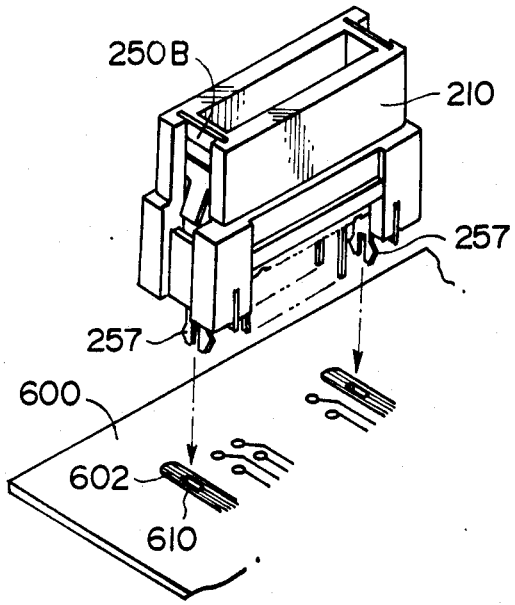
FIG. 13 is a perspective view showing an example of use of the fixture in FIG. 7.

FIGS. 7(A), (B) and (C) are a plan view, a front view and a side view respectively, showing an example of a vertical type female fixture. The vertical type female fixture 250B is similar in construction to the female fixture 250 shown in FIG. 4, except that its rear end part is provided with board fixation legs 257 which extend straight. This vertical type female fixture 250B is suited to attach and fix the receptacle connector perpendicularly to the plane of a printed circuit board 600 as illustrated in FIG. 13. In this case, the board fixation legs 257 of the fixture 250B are inserted into the fixation hole 601 of the circuit board 600 and come into touch with an earth conductor 602 deposited around the hole.

FIGS. 8(A), (B) and (C) are a plan view, a front view and a side view respectively, showing an example of a vertical type male fixture. The vertical type male fixture 150A is similar in construction to the male fixture 150 shown in FIG. 2, except that its rear end part is provided with board fixation legs 156 which extend straight. Therefore, the corresponding parts are assigned the same reference numerals and shall not be explained in detail.

FIGS. 9(A), (B) and (C) are a plan view, a front view and a side view respectively, showing an example of an L-shaped male fixture. Also the L-shaped male fixture 150B is similar in construction to the male fixture 150 shown in FIG. 4, except that its rear end part is put into an L-shaped portion, the front end of which is provided with board fixation legs 157. Therefore, the corresponding parts are assigned the same reference numerals and shall not be explained in detail.

As set forth above, a connecting and engaging fixture for an electric connector according to the present invention achieves the function of fixing a cable restraint member in engagement and besides the function of locking the snug fitting of connectors, by means of the single member in spite of a simple structure. Moreover, in case of a female fixture for use in a receptacle connector, the side wall of a female insulating housing proper is usually rendered very thin for the purpose of miniaturization, and hence, the function of enhancing the strength of the thin side wall can be achieved. Furthermore, according to the construction of the fixture of the present invention, a function for earth connection to a shield case and a function for attachment and fixation to a printed circuit board can be readily added, and a multipurpose useful fixture can be fabricated.

We claim:

1. A connecting and engaging fixture for an electric connector, the electric connector having an insulating housing proper in which a contact is disposed and which is snugly fitted with an insulating housing proper of a mating electric connector, and a cable restraint plate which is assembled to the insulating housing proper and which serves to fix a cable end part to be spliced to the contact; said connecting and engaging fixture comprising a locking portion at its front end part, which serves to hold snug fitting between said electric connector and said mating electric connector in engagement; a rearward falling-off preventive engagement portion at its intermediate part, which serves to check said fixture from falling off rearwards in engagement with a rearward falling-off preventive engagement step provided in a fixture inserting hole formed at a side part of said insulating housing proper; and a forward falling-off preventive shoulder and a cable restraint plate-engagement portion at its rear end part, the former of which serves to check said fixture from falling off frontwards in engagement with a forward falling-off preventive engagement step provided in said fixture inserting hole, and the latter of which engages said cable restraint plate in order to fasten said cable restraint plate assembled to said insulating housing proper in engagement.

2. A connecting and engaging fixture for an electric connector as defined in claim 1, wherein said locking portion is constructed of a locking protrusion.

3. A connecting and engaging fixture for an electric connector as defined in claim 1, wherein said locking portion is constructed of a locking opening.

4. A connecting and engaging fixture for an electric connector as defined in claim 1, wherein said rear end part or said intermediate part is provided with a contiguous portion which touches a part of an electrically conductive shield case surrounding said insulating housing proper of said electric connector.

5. A connecting and engaging fixture for an electric connector as defined in claim 1, wherein said rear end part is provided with board fixation legs which extend straight.

6. A connecting and engaging fixture for an electric connector as defined in claim 1, wherein said rear end part is in the shape of letter L, and board fixation legs are provided at a fore end of the L shape.

* * * * *